US005562440A

United States Patent [19]

Rodgers

[11] Patent Number: 5,562,440

[45] Date of Patent: Oct. 8, 1996

[54] GAS BURNER WITH RADIANT RETENTION HEAD

[75] Inventor: Ian M. Rodgers, Chattanooga, Tenn.

[73] Assignee: Burner Systems International, Inc., Chattanooga, Tenn.

[21] Appl. No.: 392,376

[22] Filed: Feb. 21, 1995

[51] Int. Cl.[6] ..... F23D 14/12

[52] U.S. Cl. ..... 431/328

[58] Field of Search ..... 431/328, 354, 431/7

[56] References Cited

U.S. PATENT DOCUMENTS

| | | | |
|---|---|---|---|
| 1,051,367 | 1/1913 | Fisher | 431/328 |
| 3,067,811 | 12/1962 | Webster | 431/328 |
| 4,673,349 | 6/1987 | Abe et al. | 431/328 |
| 5,186,620 | 2/1993 | Hollingshead | 431/354 |

*Primary Examiner*—Carroll B. Dority

*Attorney, Agent, or Firm*—Alan Ruderman

[57] ABSTRACT

An inshot-gas burner for gas burning furnaces and other gas burning appliances has a flame retention head at the outlet formed from porous ceramic foam with a central opening through which a flame may project. A velocity reducing insert is located within the mixing chamber of the burner for reducing the velocity of the mixture received by the head in the area spaced about the central openings so that the head is radiant in operation. The porosity of the foam is in the order of 20 to 60 pores per inch. When radiant, the head permits the burner to operate at higher primary aerations, and provides faster burning velocity and thus lower residence time, and additionally provides a lower maximum temperature and a stable quiet flame. This permits the burner to emit low amounts of nitric oxide and nitrogen dioxide without increasing the amount of carbon monoxide emissions. The head may be formed from other materials and the velocity reduction may be provided by other structures, one of which is a composite head having restrictive discreet porting.

15 Claims, 1 Drawing Sheet

GAS BURNER WITH RADIANT RETENTION HEAD

BACKGROUND OF THE INVENTION

This invention relates to gas burners, and particularly to inshot gas burners having a flame retention head which is radiant in operation thereby to permit operation at higher primary aeration and increasing the burning velocity resulting in low nitric oxide and nitrogen dioxide emissions, as well as low carbon monoxide emissions, and a quiet, stable compact flame.

Inshot-type burners used in gas furnaces and other gas fired appliances have an inlet into which combustible gas is fed under pressure and into which primary air or aeration is drawn, the burner having a venturi configuration, i.e., a reduced cross section between its ends, which produces a low pressure for drawing in the primary air. The air and gas are mixed in a diverging portion of the burner downstream of the venturi and burned as the mixture exits from the outlet end of the burner. Secondary air, i.e., additional air required to complete combustion, is induced into the burning mixture from outside the burner just prior to the flame entering the heat exchanger of the furnace or appliance. To enhance the flame stability to prevent the flame from burning downstream of the outlet end or head of the burner, a flame retention device in the form of an insert may be placed at the outlet end or head of the burner. The primary air-gas mixture flows through the insert and burns as it exits. If the flow velocity of the air-gas mixture is too great relative to the flame speed, i.e., the burning velocity, the flame will lift off the exit end of the burner body of the insert resulting in flame instability, noise and carbon monoxide. If the flow velocity of the air-gas mixture is too slow relative to the flame speed, the gas will burn within the burner itself, a condition known as flashback, resulting in overheating of the burner.

Flame retention in the prior art have been solid mass devices generally formed from sintered or powdered metal into small blocks. An example is the insert illustrated in U.S. Pat. No. 5,108,284 which describes a block having a large central opening with a plurality of teeth extending radially at the periphery of the block. A plurality of smaller apertures disposed radially about the central opening and also having a series of openings formed by stepped notches at the periphery is described in U.S. Pat. No. 5,186,620.

The aforesaid prior art flame retention inserts have generally only been concerned with flame stability, avoidance of excessive noise and limiting the production of carbon monoxide. This has been achieved by creating low velocity zones around the periphery of the outlet and/or eddy currents or recirculation vortex currents which help retain the flame while keeping primary aeration, i.e., the amount of primary air, at or below 50% of the total air required for combustion. The prior art burner heads or inserts are generally only stable to approximately 50% primary aeration. Above this primary aeration level, the burners become unstable and significant amounts of toxic carbon monoxide are produced, as is high noise. When burning fossil fuels such as methane the ideal products of combustion are $CO_2$ and $H_2O$. In practice, when using air as the oxidant, the nitrogen in the air dissociates at high temperature and is oxidized to nitric oxide (NO) and nitrogen dioxide ($NO_2$). The amount of NO produced is dependant on the maximum temperature and the time spent at this temperature, i.e., residence time. The formation of nitric oxide (NO) and nitrogen dioxide ($NO_2$), both of which may hereinafter be referred to as $NO_x$, has not been addressed by prior art burner designs.

Unfortunately, as the amount of carbon monoxide is reduced with the prior art burner designs, the amount of $NO_x$ is increased, and vice versa. The amount of $NO_x$ produced is dependent upon the maximum temperature and the residence time of the burning mixture at that temperature. The formation of $NO_x$ is undesirable since it contributes to acid rain and the formation of smog. For this reason California has imposed restrictions on the amount of $NO_x$ emissions of gas burning appliances. In the prior art, however, any reduction of the $NO_x$ emissions, required for the appliance, is normally achieved by the addition of a flame cooling insert in the first combustion tube of the appliance. This cooling insert has been made from a high temperature material, and thus is relatively expensive, and is also prone to failure, and may increase carbon monoxide levels.

SUMMARY OF THE INVENTION

Consequently, it is a primary object of the present invention to provide a gas burner for gas burning appliances which produces low $NO_x$ (nitric oxide and nitrogen dioxide) and low carbon monoxide emissions, has low noise and a short and stable flame.

It is another object of the present invention to provide a gas burner for gas burning appliance having a flame retention head at the outlet end which when provided with a low velocity air-gas mixture about the outer portion thereof glows in a radiant mode while a flame extends from at least one opening in the head, the head providing a faster burning velocity and thus lower residence time at maximum temperature while additionally lowering the maximum temperature.

It is a further object of the present invention to provide a gas burner for gas burning appliances having a porous radiant retention head at the outlet end which has at least one aperture through which a flame may extend and which is provided with a lower velocity area about the aperture so that in operation it glows in a radiant mode, the radiant retention mode permits operation at increased primary aeration providing a compact, short, stable flame and low $NO_x$ and carbon monoxide exhaust emissions.

Accordingly, the present invention improves the combustion of inshot type burners to obtain low $NO_x$ emissions, very low carbon monoxide emissions, with a quiet, stable, compact flame. The lower $NO_x$ emissions are achieved by reducing the maximum flame temperature and the residence time by means of a radiant flame retention head at the outlet end of the burner. The radiant flame retention head increases the burning velocity, i.e., reduces the time required for complete combustion, and thereby reduces the time at high temperature where significant amounts of $NO_x$ are formed. It also provides a zone of reignition and high stability around the normally most quenched portion of the flame, thereby leading to significantly lower carbon monoxide emissions. The radiant retention also provides a compact, short, stable flame which may be beneficial to appliances with which the burner is used so that smaller, more compact heat exchangers may be utilized and less deterioration of the heat exchanger may result by avoiding direct impingement on the first return bend thereof.

The radiant flame retention head of the present invention is a porous member mounted at the end of the burner and has a central discreet outlet portion through which the flame exits while a portion of the gas-air mixture permeates through the pores of the outer section and radiates or glows at the exterior end of the member. Other discreet smaller ports may be disposed about the central port and project smaller flame cones than that of the central outlet port. Preferably the porous member comprises a ceramic foam material, although a porous structure formed from layers of ceramic or metal fibers may be utilized. The radiant mode of the retention head is obtained by providing the gas-air mixture at a low velocity to the radially outer portion of the member in various ways.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
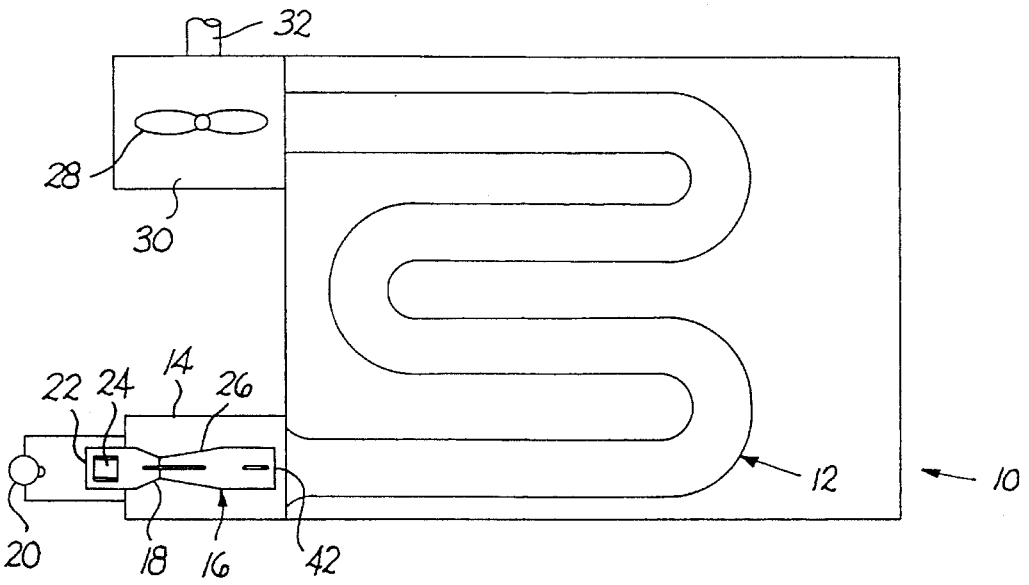
FIG. 1 is a diagrammatic view of a furnace heated by an inshot-type burner constructed in accordance with the preferred form of the present invention.
Figure 3:
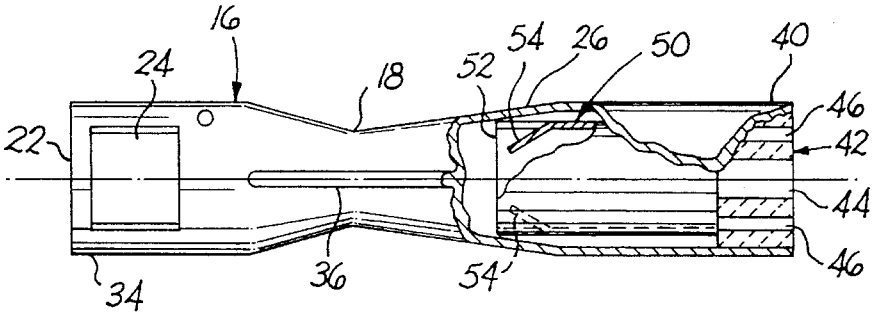
FIG. 3 is an elevational view of the burner of FIG. 2 with portions broken away and cross sectioned.
Figure 4:
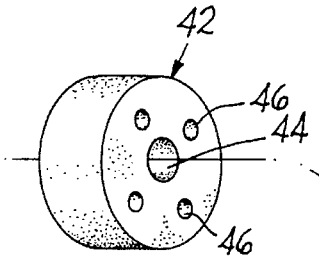
FIG. 4 is a perspective view of the preferred form of the radiant retention head of the present invention.
Figure 5:
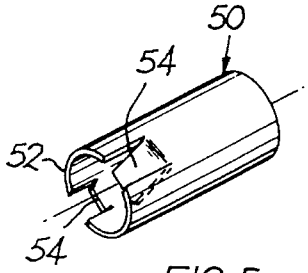
FIG. 5 is a perspective view of a low velocity enhancing insert incorporated in the burner.
Figure 2:
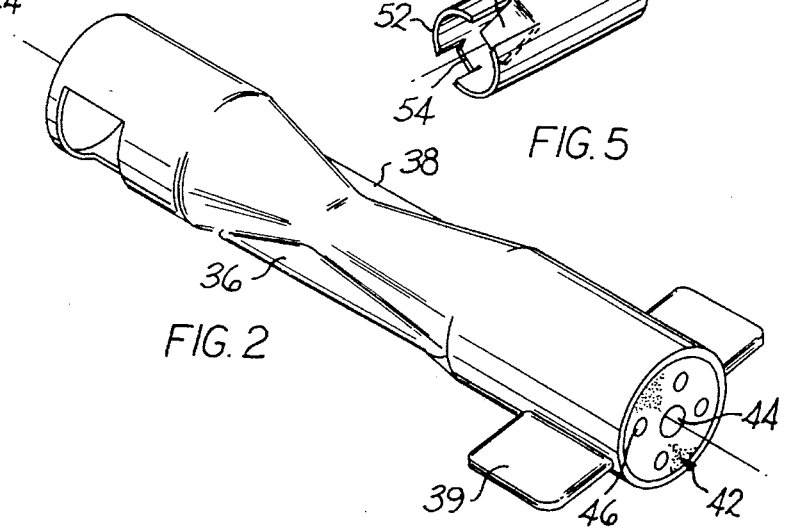
FIG. 2 is a perspective view of the burner illustrated in FIG. 1.

An inshot-type gas burner according to the present invention may be used in high efficiency fan induced gas fired furnaces, or in non-combustion fan applications, including gas burning appliances such as gas fired clothes dryers and similar appliances. As illustrated in FIG. 1, a high efficiency gas furnace 10 generally includes a serpentine heat exchanger 12 and may have a combustion box 14 mounted at the inlet end for controlling the secondary air used in conjunction with at least one burner 16 mounted in or adjacent thereto. The burner 16 is of the inshot-type having a reduced cross sectional area forming a venturi or throat 18. Gas such as natural gas or propane or the like from a gas manifold 20 enters the inlet 22 of the burner 16 under pressure and mixes with primary air which enters through an air inlet 24, the air being drawn through the inlet by the reduced pressure within the burner resulting from the venturi 18 or a combustion fan. The gas and air mix to form a combustible gas-air mixture within a mixing section 26 of the burner which preferably has an expanding or diverging configuration, and the mixture may thereafter be ignited downstream of the mixing section where combustion occurs. A controlled amount of secondary air is received from the combustion box 14 at the outlet end of the burner to complete the combustion process, and the flame and hot gases enter the inlet of the heat exchanger 12. A blower or fan 28, used with high efficiency furnaces, that may include restrictive heat exchangers designed to extract the latent heat from water vapor in the combustion products, may draw the flue gases from the heat exchanger into a flue discharge box 30 and exhaust through a flue pipe 32. This generally describes a conventional gas fired appliance within which the burner 16 of the present invention may be utilized.

The inshot-burner 16 of the present invention has a main body including an entry end 34 together with the venturi 18 and the mixing section 26, which may comprise a single tube of metal pinched to provide the reduced area venturi and a pair of smash wings 36, 38 or may be formed from a pair of stamped metal plate members each deformed to form half of the burner passageway, or even a single plate. An adjustable collar or shutter (not illustrated) may be positioned about the entry end 34 and disposed for controlling the area of the opening forming the inlet 24 so as to control the amount of primary aeration. Additionally the burner may have integral flame cross-over facility such as wing 39 or the like. At the burner head or outlet end 40 of the burner 16 the present invention provides a flame retention head 42 which may operate in a radiant mode and forms a novel flame retention head of the present invention.

In the preferred embodiment of the present invention the retention head 42 comprises a block of ceramic porous foam material which preferably may be an insert received within the body of the burner at the head or outlet end 40 as illustrated, or may be an extension at the end of the body. The porous head 42 includes a primary discreet central outlet port 44 and may include additional smaller ports 46 which may be desired and be dependent upon the porosity of the material forming the retention head. A retention head 42 formed from ceramic foam should have a porosity in the range of 20 to 60 pores per inch with 30 pores per inch appearing to be ideal. The ceramic material preferably may be aluminum oxide, although silicon carbide, silicon oxide and other ceramic materials that may be formed into a porous foam structure would be satisfactory. The porous foam structure may be provided by the replica process whereby an organic foam or sponge material, such as polyurethane, having the desired porosity, is dipped into the ceramic material while in the liquid state so as to become saturated with the ceramic material. After the ceramic material dries, the foam or sponge material is burned off thereby leaving the ceramic material in the form of a porous foam.

The porous material around the port 44 and any additional ports 46, if used, will glow in a radiant mode if the velocity of the gas-air mixture which it receives is low. Thus, a low velocity mixture should be provided to the radially outer regions of the head 42. The interior of the inshot-burner should be provided with some means for providing this low velocity region. Since a divergent configuration will slow down the mixture with the velocity tending toward zero at the outer walls, the divergent section 26 may, if desirable, be extended toward the head. The lower velocity region may, however, be enhanced in a number of ways.

Low velocity enhancement, for example, may be provided by diverting a portion of the gas-air mixture to the periphery of the head. This may be provided by the use of vanes which intercept a portion of the flow to slow it down. To this end an insert 50 in the form of a hollow cylindrical member, preferably formed from the same metal as the body of the burner, may be inserted into the body of the burner with the leading edge 52 of the insert contacting the wall of the divergent section and be welded thereto. Tabs 54, which form vanes, are cut and bent out of the insert at and to adjacent the leading edge toward the center of the insert and act to divert the mixture flowing therethrough. When the mixture is diverted, the velocity downstream of the vanes is reduced substantially. Preferably, there are a pair of vanes or tabs spaced 180° apart and may be bent inwardly at an angle of approximately 37 ½° from the periphery of the insert. Alternatively, the means for providing the lower velocity region at the radially outer portion of the head may be a pressure drop plate, such as a plate having a plurality of apertures or perforations, followed by an expansion zone wherein the mixture will slow prior to entering the head 42.

Figure 6:
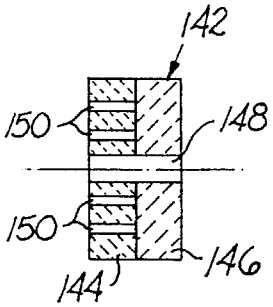
FIG. 6 is a cross sectional view through a second embodiment of a radiant retention head in combination with the low velocity enhancing member constructed in accordance with the present invention.

Another means for providing the lower velocity region may be provided by restrictive discreet porting spaced to reduce the flow in the outer portion of the foam head. FIG. 6 illustrates one such means for accomplishing this. Here the retention head 142 may be a composite of a ceramic tile portion 144 and a porous foam portion 146, the solid portion 144 being disposed in the burner upstream from the foam portion 146. The head 142 includes a central opening 148 which extends through both portions 144 and 146, while the solid portion includes a plurality of restrictive discreet ports 150, the number of ports 150 and the spacing thereof providing the reduction in flow to the radially outer area of the foam portion 146.

Although the ceramic foam material as heretofore described is the preferred mode of the invention, the head 42, 142 may be formed from other materials which may be made porous. For example, ceramic fibers or metal fibers may be layered upon each other and sintered, woven or otherwise formed together into a porous head. If these materials radiate and insulate, so that the flame front will be within the material and not propagate back to the burner, satisfactory results should occur.

In operation most of the primary gas-air mixture passes through the central discreet port 44, with other amounts of the mixture passing through the additional ports 46, if any, and of course, the remainder permeates through the porous section. The area around the ports, i.e., the porous section, becomes radiant and provides the radiant retention. The radiant retention permits increased primary aeration, and increases the burning velocity reducing the time required to complete combustion. Thus, the time at high temperatures is reduced. Since significant amounts of $NO_x$ are formed at high temperatures, the amount of $NO_x$ is substantially reduced relative to the prior art burners. The radiant retention also provides a zone of reignition and high stability around the previously most quenched part of the flame. In the prior art, the central section of the flame is protected by the outer mantle of the flame from direct quenching caused by the secondary air. This outer mantle is quenched by the cooling secondary air and the relatively cool burner body. If the flame temperature is cooled below approximately 1100° C., significant amounts of carbon monoxide may be produced. The radiant retention area about the flame, provided by the present invention, reduces the quenching effect on the outer mantle and thereby provides significantly lower carbon monoxide emissions. The radiant retention also provides a compact, short and stable flame.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. An inshot-gas burner comprising an elongated body defining a passageway therethrough having an inlet opening at one end for receiving a combustible gas and primary air, an outlet opening at the other end, a reduced area venturi intermediate said ends, a mixing section intermediate said venturi and said outlet for permitting mixing of said gas and said air to provide a combustible gas-air mixture, a radiant flame retention device at said outlet, said device comprising a porous body member having a central opening through which a flame may project, and velocity reducing means in said mixing section for reducing the velocity of the mixture at the periphery of the mixing section adjacent the outlet so that the velocity of the mixture at the porous body member outwardly of the central opening is low relative to the velocity entering the central opening, whereby upon ignition a flame may project through said central opening downstream of said outlet and the surface of said porous body downstream of said opening may radiate.

2. An inshot-gas burner as recited in claim 1, wherein said porous body comprises ceramic foam material.

3. An inshot-gas burner as recited in claim 2, wherein the porosity of said foam is in the range of 20 to 60 pores per inch.

4. An inshot-gas burner as recited in claim 2, wherein the porosity of said foam is approximately 30 pores per inch.

5. An inshot-gas burner as recited in claim 1, wherein said velocity reducing means comprises vanes disposed within said mixing section extending from the periphery of said passageway toward the center of said passageway.

6. An inshot-gas burner as recited in claim 5, wherein said porous body comprises ceramic foam material.

7. An inshot-gas burner as recited in claim 6, wherein the porosity of said foam is in the range of 20 to 60 pores per inch.

8. An inshot-gas burner as recited in claim 7, wherein the porosity of said foam is approximately 30 pores per inch.

9. An inshot-gas burner as recited in claim 1, wherein said velocity reducing means comprises a solid body fixed to said porous body, said solid body having a central opening aligned with and forming a continuation of the central opening in said porous body, said solid body including a plurality of discreet ports spaced from and disposed about the central opening therein to reduce the flow of said mixture to the adjacent portion of said porous body.

10. An inshot-gas burner as recited in claim 9, wherein said porous body comprises ceramic foam material.

11. An inshot-gas burner as recited in claim 10, wherein the porosity of said foam is in the range of 20 to 60 pores per inch.

12. An inshot-gas burner as recited in claim 11, wherein the porosity of said foam is approximately 30 pores per inch.

13. An inshot-gas burner as recited in claim 9, wherein said solid body and said porous body form a composite ceramic structure, said porous body comprising ceramic foam material.

14. An inshot-gas burner as recited in claim 13, wherein the porosity of said foam is in the range of 20 to 60 pores per inch.

15. An inshot-gas burner as recited in claim 14, wherein the porosity of said foam is approximately 30 pores per inch.

* * * * *